US008956672B2

(12) United States Patent
Yoakim et al.

(10) Patent No.: US 8,956,672 B2
(45) Date of Patent: Feb. 17, 2015

(54) CAPSULE FOR PREPARING COFFEE IN A DEVICE COMPRISING A CARTRIDGE HOLDER WITH RELIEF AND RECESSED ELEMENTS

(75) Inventors: Alfred Yoakim, St. Legier la Chiesaz (CH); Alexandre Perentes, Lausanne (CH); Arnaud Gerbaulet, Oye et Pallet (FR)

(73) Assignee: Nestec S.A., Vevey (CH)

( * ) Notice: Subject to any disclaimer, the term of this patent is extended or adjusted under 35 U.S.C. 154(b) by 1072 days.

(21) Appl. No.: 12/727,861

(22) Filed: Mar. 19, 2010

(65) Prior Publication Data

US 2010/0239717 A1 Sep. 23, 2010

(30) Foreign Application Priority Data

Mar. 19, 2009 (EP) ..... 09155571
Aug. 26, 2009 (EP) ..... 09168660

(51) Int. Cl.
*B65B 29/02* (2006.01)
*B65D 85/804* (2006.01)

(52) U.S. Cl.
CPC ..... *B65D 85/8043* (2013.01)
USPC ..... 426/77; 426/79; 99/295

(58) Field of Classification Search
CPC ..... B65D 85/8043
USPC ..... 426/77–79, 82, 86, 112, 115, 394, 426/431–433; 99/295, 495, 279, 300
See application file for complete search history.

(56) References Cited

U.S. PATENT DOCUMENTS

| | | | | |
|---|---|---|---|---|
| 3,292,527 A | | 12/1966 | Stasse | 99/295 |
| 4,053,371 A | | 10/1977 | Towsley | 204/20 |
| 4,846,052 A | | 7/1989 | Favre et al. | 99/295 |
| 4,853,234 A | | 8/1989 | Bentley et al. | 426/77 |
| 4,867,993 A | * | 9/1989 | Nordskog | 426/77 |
| 4,886,674 A | | 12/1989 | Seward et al. | 426/79 |

(Continued)

FOREIGN PATENT DOCUMENTS

| | | |
|---|---|---|
| BE | 1 006 165 A5 | 5/1994 |
| CN | 1514795 A | 7/2004 |

(Continued)

OTHER PUBLICATIONS

Machine translation of FR 2617389.*

(Continued)

*Primary Examiner* — Rena L Dye
*Assistant Examiner* — Chaim Smith
(74) *Attorney, Agent, or Firm* — K&L Gates LLP

(57) ABSTRACT

A capsule for the production of a beverage in a beverage production machine comprising a capsule holder with relief and recessed elements. The capsule includes an inverted cup-shaped body forming a chamber containing beverage ingredients; a bottom injection wall; a sidewall; and a delivery wall which is sealed to the body. The delivery wall is configured and dimensioned to include a calibrated orifice or perforating means to provide a calibrated orifice with the beverage delivery wall not being tearable against the capsule holder during extraction. The wall also provides through the restriction created by the calibrated orifice a certain back pressure which generates an elevated pressure in the capsule during extraction. Also, a system and method for producing a beverage from the capsules of the invention.

19 Claims, 9 Drawing Sheets

(56) References Cited

U.S. PATENT DOCUMENTS

| | | | | |
|---|---|---|---|---|
| 5,242,702 | A | 9/1993 | Fond | 426/433 |
| 5,402,707 | A | 4/1995 | Fond et al. | 99/295 |
| 5,472,719 | A | 12/1995 | Favre | 426/77 |
| 6,832,542 | B2 | 12/2004 | Hu et al. | 99/302 R |
| 7,393,446 | B2 | 7/2008 | Towsley | 205/109 |
| 2002/0078831 | A1 | 6/2002 | Cai | 99/295 |
| 2003/0056661 | A1 | 3/2003 | Hu et al. | 99/495 |
| 2003/0096038 | A1 | 5/2003 | Cai | 426/77 |
| 2004/0115310 | A1 | 6/2004 | Yoakim et al. | 426/77 |
| 2004/0115317 | A1 * | 6/2004 | Doglioni | 426/123 |
| 2005/0150390 | A1 | 7/2005 | Schifferle | 99/295 |
| 2006/0011066 | A1 * | 1/2006 | Bunn et al. | 99/279 |
| 2006/0110507 | A1 | 5/2006 | Yoakim et al. | 426/433 |
| 2007/0186784 | A1 | 8/2007 | Liverani et al. | 99/295 |
| 2007/0224319 | A1 | 9/2007 | Yoakim et al. | 426/433 |
| 2007/0261564 | A1 | 11/2007 | Liverani et al. | 99/279 |
| 2009/0280219 | A1 | 11/2009 | Yoakim et al. | 426/77 |

FOREIGN PATENT DOCUMENTS

| | | | | |
|---|---|---|---|---|
| EP | 0 179641 | B1 | 4/1986 | |
| EP | 0 242 556 | A1 | 10/1987 | |
| EP | 0 468 078 | A1 | 1/1992 | |
| EP | 0 468 079 | B1 | 1/1992 | |
| EP | 0 512 246 | B1 | 11/1992 | |
| EP | 0 512 468 | B1 | 11/1992 | |
| EP | 0 512 470 | B1 | 11/1992 | |
| EP | 0 554 469 | B1 | 8/1993 | |
| EP | 1 165 398 | B1 | 1/2002 | |
| EP | 1 273 528 | B1 | 1/2003 | |
| EP | 1 579 792 | B1 | 9/2005 | |
| EP | 1 654 956 | B1 | 5/2006 | |
| EP | 1 654 966 | A1 | 5/2006 | |
| EP | 1 700 548 | B1 | 9/2006 | |
| EP | 1 702 543 | B1 | 9/2006 | |
| EP | 1 929 904 | A1 | 6/2008 | |
| FR | 2617389 | A1 * | 1/1989 | A47J 31/40 |
| WO | WO 02/058522 | A2 | 8/2002 | |
| WO | WO 02/081337 | | 10/2002 | |
| WO | WO 03/073896 | A1 | 9/2003 | |
| WO | WO 2005/092160 | A1 | 10/2005 | |
| WO | WO2008/148646 | A1 | 12/2008 | |
| WO | WO 2009084059 | A1 * | 7/2009 | A47J 31/06 |

OTHER PUBLICATIONS

Search Report, European Application No. 09155575, Oct. 7, 2009.
Search Report, European Application No. 10156614, Jun. 24, 2010.
European Search Report, EP 09155571, mailed Oct. 9, 2009.

* cited by examiner

CAPSULE FOR PREPARING COFFEE IN A DEVICE COMPRISING A CARTRIDGE HOLDER WITH RELIEF AND RECESSED ELEMENTS

BACKGROUND

The present invention relates to a capsule for preparing coffee in a beverage production machine. It also relates to a coffee capsule system including such capsule.

Single-serve beverage capsules are very popular because they provide a fresh tasting beverage quickly, conveniently and in a clean fashion. Therefore, certain beverage capsule systems propose to extract a coffee liquid from roast and ground coffee ingredients contained in a capsule that opens under pressure when a sufficient amount of water fills the capsule. More particularly, the pressure of liquid increases in the capsule before the delivery face of the capsule opens thereby conferring a good quality of extraction.

In particular, the NESPRESSO® capsule system, as described in EP0512470B1, is based on the principle that an extraction face of the capsule is torn against relief and recessed elements of a capsule holder in the beverage production machine. The extraction face tears at the location of these relief elements and/or recessed elements on reaching the breaking stress to enable the liquid, e.g., coffee extract, to be removed after extraction of the coffee under a certain positive pressure. EP0512468B1 also describes a capsule which is adapted for such extraction process and device.

Although such process produces an outstanding coffee quality due to this retarded opening of the extraction face of the capsule, the opening of the face may be difficult to repeatedly control as it depends on many different factors. Therefore, the extraction face is generally formed of a membrane having a very precisely controlled thickness of aluminum, in particular, of about 30 microns. Despite all care taken for designing such capsule, the opening of the membrane may be more or less retarded and the consistency of the flow may also be affected in some way depending on the characteristics of the ground coffee, the sizes of the perforations through the membrane, etc.

Many patents describe capsules which do not fit into a beverage production device comprising a capsule holder comprising relief and recessed elements as aforementioned.

U.S. Pat. No. 3,292,527 relates to an apparatus and cartridge wherein the cartridge comprises a truncated cup sealed by an upper foil, the bottom of the cup being a disc formed of small perforations in the fashion of a sieve. This disc is intended more particularly for infusions, lixivations and decoctions (coffee, tea, lime-blossom, etc.). The apparatus has a capsule holder with a large hole such that a direct flow can be provided from the capsule with reduced contact with the machine.

WO02/058522A2 relates to a cartridge and method for making fluid comestibles comprising a bulb-like or cylindrical body which comprises one or more compartment for beverage ingredients, a filter and possibly an outlet extension comprising an opening which can be an orifice that is restrictive or small enough to produce a high speed or stream of fluid enabling the production of foam or coffee crema. However, the capsule is not designed for matching a capsule holder comprising relief and recessed elements. Furthermore, the outlet extension is designed essentially for forming a coffee jet and therefore for improving creation of coffee crema.

EP1579792B1 relates to an integrated cartridge for extracting a beverage from a particulate substance comprising an internal volume comprising valve means, in particular, a pad or disc of a resilient material which comprises at least one through slit or orifice that is normally closed for insulating the internal volume of the cartridge and for retaining liquid residuals inside the internal volume when the beverage extraction has been terminated. However, such cartridge is relatively complicated and comprises a protruding outlet nozzle non-compatible in engagement on a capsule holder comprising relief and recessed elements.

Accordingly, there is a need for improved products of these types and this need is now met by the products and methods of the present invention.

SUMMARY OF THE INVENTION

The invention generally relates to a capsule for the production of a beverage in a beverage production machine comprising a capsule holder with relief and recessed elements. The capsule includes an inverted cup-shaped body forming a chamber containing beverage ingredients; a bottom injection wall; a sidewall; and a delivery wall which is sealed to the body. The delivery wall is configured and dimensioned to include a calibrated orifice or perforating means to provide a calibrated orifice with the beverage delivery wall not being tearable against the capsule holder during extraction. The wall also provides through the restriction created by the calibrated orifice a certain back pressure which generates an elevated pressure in the capsule during extraction.

The delivery wall is substantially planar and a filtering wall is optionally but preferably present between the chamber and the delivery wall.

The invention also relates to a system for the preparation of a beverage comprising a beverage production machine comprising a capsule holder with relief and recessed elements and a water injection cage with a pressing edge, and one of the capsules disclosed herein, such that injection of water into the capsule forms the beverage.

The invention also relates to a method of forming a beverage by providing a capsule as disclosed herein; injecting water into the capsule for combining with the beverage forming ingredients therein to form the beverage; and withdrawing the beverage from the capsule for consumption.

A preferred beverage forming ingredient is coffee, such that the present invention specifically aims at providing a capsule solution for fitting a coffee production machine comprising a capsule holder with relief and recessed elements normally used for tearing an extraction face of a capsule, said capsule working on a different principle which, in particular, provides an appropriate build-up of pressure generating an intimate interaction between the coffee grains and water, as well as a consistent flow of the coffee delivered through the capsule.

DETAILED DESCRIPTION OF THE INVENTION

Figure 1:
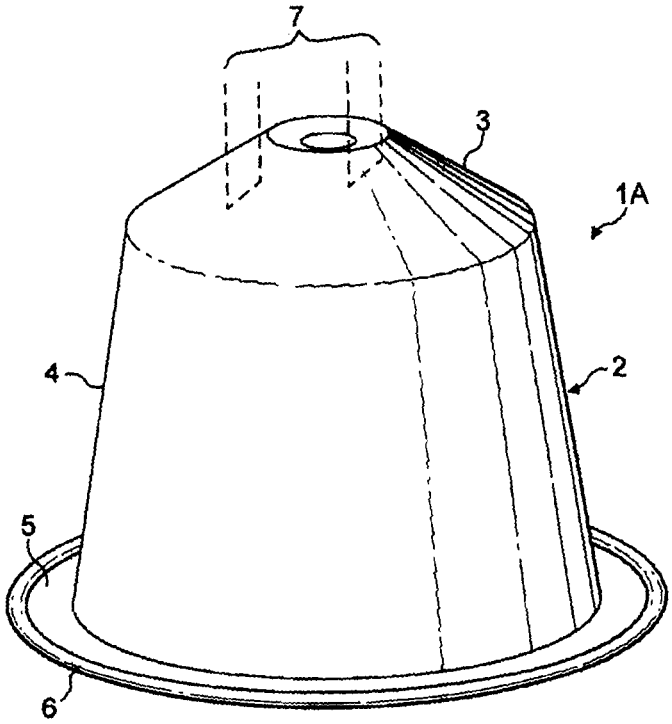
FIG. 1 shows a general view of a capsule according to the present invention.

According to the main aspect of the invention, the capsule is for the production of a beverage and more particularly coffee. The capsule is to be used in a beverage production machine comprising a capsule holder with relief and recessed elements and it comprises an inverted cup-shaped body forming a chamber containing beverage ingredients, a bottom injection wall, a sidewall; a delivery wall which is sealed to the body; optionally, a filtering wall placed between the chamber and the delivery wall.

A novel feature of the invention is that the delivery wall comprises a calibrated orifice or comprises perforating means to provide a calibrated orifice in the delivery wall and in that the delivery wall is not tearable against the capsule holder during extraction but provides through the restriction created by the calibrated orifice a certain back pressure which generates an elevated pressure in the capsule during extraction. Furthermore, the delivery wall is also preferably planar so that the capsule is capable of being properly supported onto a capsule holder comprising relief and recessed elements without significant deformation of the capsule.

In a mode, the beverage delivery wall comprises a single calibrated restriction orifice which diameter is below 1 mm, more preferably below 500 microns, most preferably between 100 and 350 microns. The restriction orifice may be obtained by several calibrated orifices wherein the sum of the diameters is below 1 mm, most preferably between below 500 microns, most preferably between 150 and 350 microns. For instance, two orifices can be provided in the wall wherein each orifice has a diameter of less than 250 microns, most preferably between 50 and 175 microns.

By the word "calibrated", it is meant that the orifice is of a substantially initially defined and relatively controllable dimension during extraction and, in particular, that the orifice does not expand of more than 500% of its initial diameter as a result of the process of extraction. For instance, if the orifice has a diameter of 150 microns at the beginning of extraction, the orifice should not have enlarged of more than about 750 microns in diameter after the extraction. More preferably, the increase in diameter should be lower than 300%. Most preferably, the increase in diameter is even lower than 150% and even ideally lower than 10%. An increase of the diameter may occur by tearing or stretching of the material of the wall around the orifice during extraction. However, in order to ensure a control of the pressure inside the capsule, such tearing or stretching should remain within the given limits and preferably be negligible.

In particular, it has been determined that the preferred ratio of the total surface of the restriction orifice(s) to the total surface of the delivery wall is comprised between about 1:800 and 1:10000, most preferably between 1:1000 and 1:9000. The surface of the delivery wall is here considered as the surface of the wall which transversally closes the chamber of the body and is thus potentially in contact with the coffee extract. It excludes the sealing surface of the delivery wall at the flange-like rim of the capsule.

The delivery wall may have a diameter of between 28 and 38 mm which can match properly on a capsule holder with relief and recessed elements. The relief and recessed elements of the capsule holder are typically provided in a metal or plastic plate which has a diameter of between 35 and 38 mm. Therefore, a correct match of the dimensions of the delivery wall and plate is obtained to ensure a pressure-tight arrangement of the capsule onto the capsule holder. Furthermore, the delivery wall of the capsule has preferably a flat outer surface. The wall must be a deformable structure if its outer surface is not fully flat, e.g., slightly convex, to be capable of taking a relatively flat configuration against the relief and recessed elements of the capsule holder. However, the convexity of the wall should normally not exceed about 2 mm at its higher deflection point relative to the transversal plane of the capsule passing by the rim.

The delivery wall of the capsule can be rigid or flexible.

It is also fully impermeable to liquid outside the said orifice thereby ensuring that the flow of beverage is entirely forced through the orifice when exiting the capsule.

The material delivery wall can be chosen amongst: aluminum, plastic or a combination of aluminum and plastic, a combination of aluminum and paper, a combination of plastic and paper, a combination of aluminum, paper and plastic. The plastic may be polypropylene, high density polyethylene, PET or polyamide.

The beverage delivery wall has preferably a thickness of between 100 and 1000 microns, most preferably between 150 and 500 microns.

For example, the wall can be an aluminum foil of thickness between 150 and 500 microns, or a polypropylene, polyamide or polyethylene foil of between 250 and 500 microns, or a multilayer of PP-PET or PP-EVOH-PP of between 250 and 500 microns. The thickness of the material is also chosen as a function of the yield strength and ultimate strength of the material so that the delivery wall does not tear during extraction on the capsule holder.

The orifice is preferably pre-fabricated in the beverage delivery wall so that it exists at the time the capsule is inserted in the beverage production machine. However, it is also within the scope of the invention, a capsule which comprises means for providing a calibrated orifice before extraction or as a result of the process of extraction in the beverage production machine. A calibrated orifice can thus be produced by a perforating element, e.g., a needle, which is part of the capsule itself. The perforating element and delivery wall may be moved relatively one another to provide the calibrated opening as a result of the mechanical interaction between the capsule and the capsule holder during closure of the machine about the capsule. The perforating element and delivery wall may be moved relatively one another to provide the calibrated opening as a result of the rise of pressure in the capsule during extraction.

The filtering wall of the capsule preferably extends across the maximal transversal cross section of the chamber to ensure an homogeneous filtering of the coffee. The filtering wall can be any filtering media capable of retaining solid particles of the beverage ingredients solids, in particular, roast and ground coffee particles. The filtering wall can be flexible or relatively rigid such as made of injected plastic. The filter can be a layer of paper, fibers (non woven or woven), an apertured plastic (PP or PE) or aluminum plate. The thickness of the filter depends on the material and may range of from about 50 to 500 microns. The filter wall ensures that the coffee particles cannot enter and clog the calibrated orifice of the beverage delivery wall. Typically, the filter wall has an average pore size of less than 300 microns, more preferably 100 and 200 microns.

The cup-shaped body has preferably a truncated shape. In one possible mode, the body is made of aluminum or of aluminum-polypropylene with the polypropylene being the inside layer. In another mode, the body is in a mono- or multilayer of plastic. For instance, the body can be made of polypropylene, polyethylene, polyamide, PP-PET or of PP-EVOH-PP. The body is preferably configured to be self-supporting. It thickness may vary of from 0.25 to 2.5 mm, more preferably 0.5 to 1.2 mm.

In another mode, the cup-shaped body is made of a biodegradable material, in particular paper or other cellulose-based material or starch-based material or plastic degradable materials such as polylactic acid. The degradable material can be permeable to liquids or be substantially impermeable if it has received an impermeable e.g., polymer, coating. A biodegradable body has preferably a thickness between 0.5 and 2.5 mm.

The cup-shaped body may comprise a closed perforable bottom or alternatively an open bottom. The bottom injection wall can be so provided with large openings (e.g., windows) enabling water to enter the capsule without requirement for perforations of the bottom wall of capsule. The openings may also be covered by a filter wall which is sealed onto the sidewall of the body. In this case, the filter may be perforated by the blades but provides a non-return effect which prevents the backflow of coffee residue through the injection perforations after extraction. The filter may also be provided as a retention means of solid particles placed inside the closed perforable bottom wall of the capsule such as it is described in EP1165398B1.

The capsule is preferably provided with a flange-like rim forming the sealing plane of the body, a filtering wall and a delivery wall. The rim is intended to be squeezed under the pressure exerted by the injection member and the capsule holder to form with the pressing surface of the capsule holder a liquid-tight arrangement resisting to the pressure of liquid building inside the capsule. Preferably, the body, filtering wall and delivery wall form, at the rim, a sealed portion which is resistant to delamination during the extraction. The rim may be of about 2 to 5 mm. The body has preferably a curled rigid flange-like rim forming a rigid support onto which the filtering wall and delivery wall can be properly sealed such as by heat or ultrasounds. The rim is preferably associated with a liquid sealing means as described in EP1654966 or EP1700548. The liquid sealing means can be an annular portion of rubber-elastic material sealed onto the rim or may be formed as a deformable part of the rim itself (e.g., a plastic and/or aluminum lip or curl).

In another mode of the present invention, the delivery wall comprises a portion of wall sealed onto the body and a separate disc-shaped element connected to the portion of wall and comprising the calibrated orifice. The advantage of this structure is that the orifice can be made through an element having different mechanical characteristic than the rest of the wall. For instance, the disc can be made of a more rigid or more heat stable material than the rest of the wall itself. In a possible mode, the disc is made of hard plastic such as a thicker piece of PP, PE, PET or rubber and is attached to a thinner wall portion of PP, PE or PET as well.

In certain modes, a bracing means is provided between the filtering wall and the delivery wall. The bracing means ensures that there is a flow gap which is maintained between the filtering wall and the calibrated orifice. The bracing element is preferably designed to maintain a gap along the full cross-section of the filtering wall to ensure a homogeneous resistance in the coffee bed and so a more homogeneous flow traversing the coffee bed and filtering wall. The bracing means can be made integral to one of the filtering or delivery walls or it can be a separate element placed between the two walls. The bracing element can have a spiral shape or be a grid or a series of small studs projecting from one of said walls in the direction of the other.

In another aspect of the invention, the calibrated orifice is arranged on the delivery wall to become axially aligned with a recessed element or channel of the capsule holder when the capsule is held in place in the beverage production machine. This configuration ensures that the flow of coffee exiting the calibrated orifice is not hindered by the close contact under pressure of the delivery wall with the relief elements of the capsule holder.

In a possible mode, the delivery wall is externally covered by a removable gas-tight membrane which covers the calibrated orifice before use. The removable membrane can be a peelable membrane connected to the delivery wall. The membrane can be made of aluminum or a laminate of plastic/aluminum or plastic comprising at least one gas barrier layer such as EVOH.

The invention is specifically exemplified by and is preferred for the production of coffee, but it is within the scope of this invention to use other beverage forming ingredients such as tea, chocolate, or other beverage producing ingredients that are provided in ground or powdered form and which form the beverage after contact with water that is preferably heated to extract the beverage ingredients from the capsule and form the beverage.

In the preferred examples, the capsule contains roast and ground coffee having an average particle diameter ($D_{4,3}$) comprised between 250 and 600 microns. When the capsule is closed in gastight fashion by means of gas-barrier materials, the capsule may contain added inert gas than normal air, e.g., nitrogen, to maintain freshness of coffee longer.

In general, the body of the capsule has preferably a height comprised between 27 and 30 mm. The flange-like rim of the capsule has preferably a width comprised between 3 and 5 mm.

The present invention can also relates to the combination of a capsule as aforementioned and a beverage production machine comprising a capsule holder wherein said capsule holder has relief elements and recessed elements for holding the beverage delivery wall of the capsule.

Figure 2:
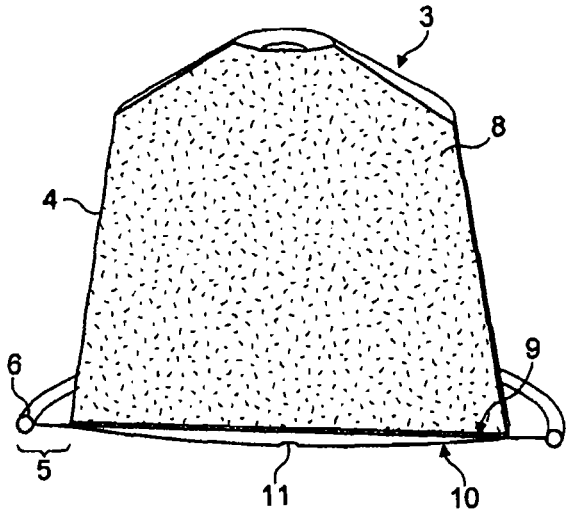
FIG. 2 shows a perspective and cross sectional view of a capsule according to a first embodiment.
Figure 3:
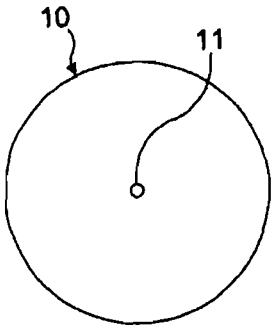
FIG. 3 shows a bottom view of the capsule of FIG. 2.

A first embodiment of the capsule 1A of the present invention is illustrated in FIGS. 1 to 3. The capsule 1A comprises a self-supporting cup-shaped body 2 with a bottom wall 3 intended for the injection of water in the capsule, truncated sidewall 4, a flange-like rim 5 extending outwardly and terminated by a curled end 6. As aforementioned, the body can be made of aluminum and/or plastic and may be relatively stiff to not collapse when it is perforated by blades 7 (shown in dotted lines in FIG. 1) of the beverage production machine; which blades provide openings through the capsule for the water injection. The cup-shaped body defines a chamber 8 containing the beverage ingredients, preferably roast and ground coffee. The dose of roast and ground coffee may vary depending on the type of coffee (ristretto, espresso or lungo). Generally, the amount of coffee contained in the chamber is of between 5 and 7 grams. The coffee powder is generally a blend of different origins of Arabica and/or Robusta ground coffees.

The chamber of the body is closed by a filtering wall 9 which extends along the entire section of the base of the body. The filtering wall preferably seals on the rim 5 of the body although it could also be sealed on the internal surface of the sidewall. The filtering wall can be flexible or rigid depending on the type of material used (paper, aluminum or plastic). The filter has many pores or small orifices all over its section to ensure a homogeneous flow of coffee through it. The filtering wall should oppose a relatively low pressure resistance to the flow but must prevent the non-soluble coffee particles (e.g., $D_{4,3}$ of 90 microns and above) from traversing the wall.

The capsule further comprises a beverage delivery wall 10 also preferably sealed onto the rim of the body. Importantly, the delivery wall 10 has a calibrated orifice 11 of controlled size. The capsule is thus designed that all coffee liquid must pass through this single orifice to exit the capsule. It has been determined that the orifice should be preferably lower than 500 microns, most preferably comprised between 150 and 350 microns. The wall is thus made of a liquid-impermeable material such as aluminum and/or plastic except at the orifice which constitutes the mandatory restrictive passage for the coffee liquid.

Figure 4:
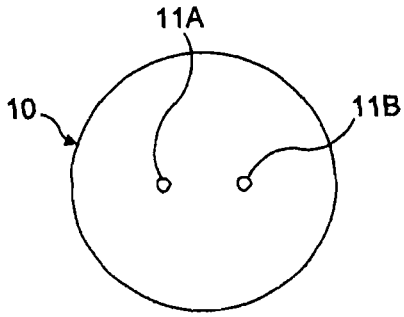
FIG. 4 shows a bottom view of the capsule of FIG. 2 according to a variant.
Figure 5:
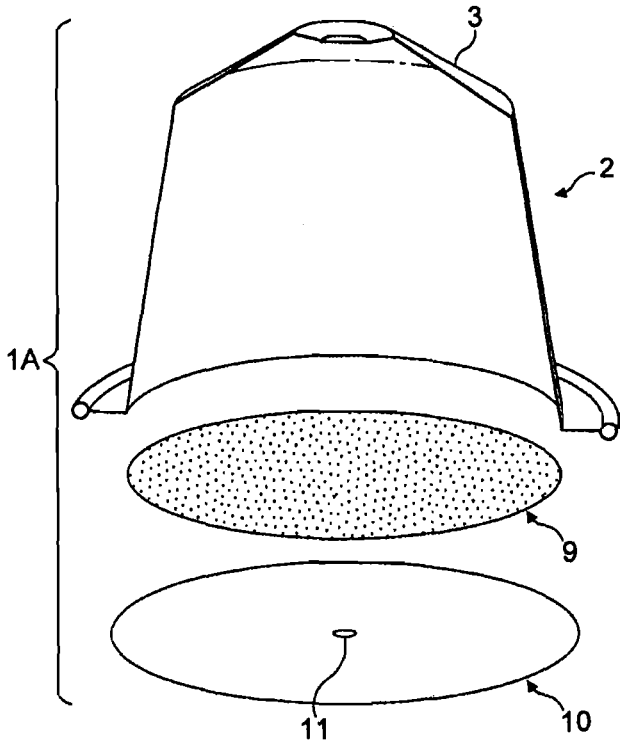
FIG. 5 shows an exploded view of the capsule of FIG. 2.

FIG. 4 shows a variant in which two calibrated orifices 11A, 11B are provided. The sum of the diameters of the orifice is also below 500 microns.

The diameter of the orifice(s) is determined to ensure a relatively high back-pressure at the delivery wall. Such back-pressure ensures a rise of pressure in the chamber at the beginning of the coffee extraction and a high pressure maintained during the extraction. The back-pressure created in the delivery wall is much higher than the pressure loss created through the filter. The pressure may vary during the extraction since the coffee bed tends to become more compact as the extraction takes place thus creating a higher resistance to the flow.

The diameter of the calibrated orifice for a capsule intended for a ristretto-type coffee can be calibrated smaller, e.g., between 100 and 150 microns, than the diameter for a capsule for an espresso-type coffee, e.g., between 120 and 250 microns. Similarly, the orifice for a lungo coffee capsule can be calibrated larger, e.g., between 180 and 350 microns, than for an espresso coffee capsule. The calibration of the orifice also depends on other factors such as the coffee blend, coffee weight and the average particle size of coffee.

In general (for all the modes of the invention), the water injection pressure (as measured at the water outlet of the capsule cage) reaches a value during extraction of at least 5 bars, preferably of at least 6 bars, most preferably of at least 7 bars. Most of the pressure drop is created by the calibrated orifice and a minor proportion comes from the bed of coffee. The pressure drop in the coffee bed may vary of from about 0.5 to 1.5 bar. The overall pressure in the capsule is preferably of about 8-9 bars for a lungo coffee and up to 15 bars for a ristretto.

It should also be noted that the diameter of the orifice may depend on the type of coffee to be extracted. For a lungo coffee which requires a lower pressure and faster flow, the orifice is chosen to be slightly greater (e.g., 10 to 50% greater) than for an espresso or ristretto coffee.

Figure 6:
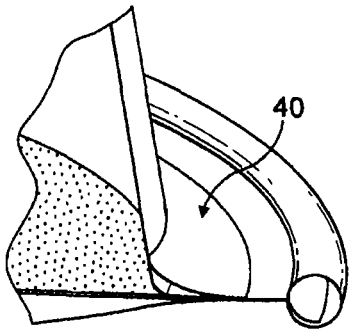
FIG. 6 shows a detail of the capsule of FIG. 2.
Figure 7:
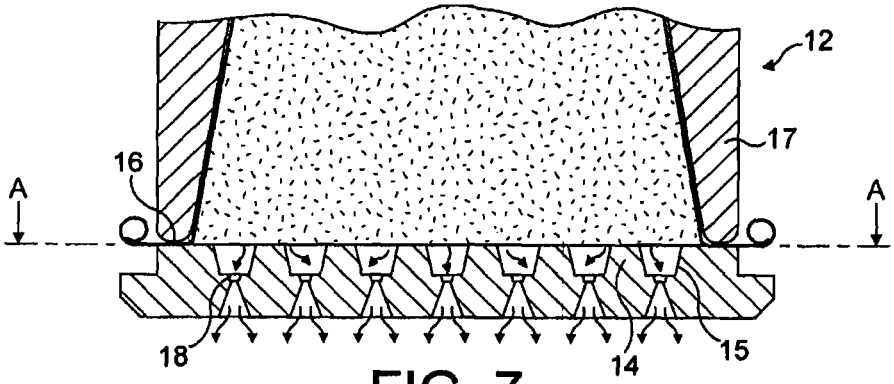
FIG. 7 shows a detail of the extraction process of the capsule of the invention in the beverage production machine having a capsule holder with a standard plate comprising relief and recessed elements.
Figure 8:
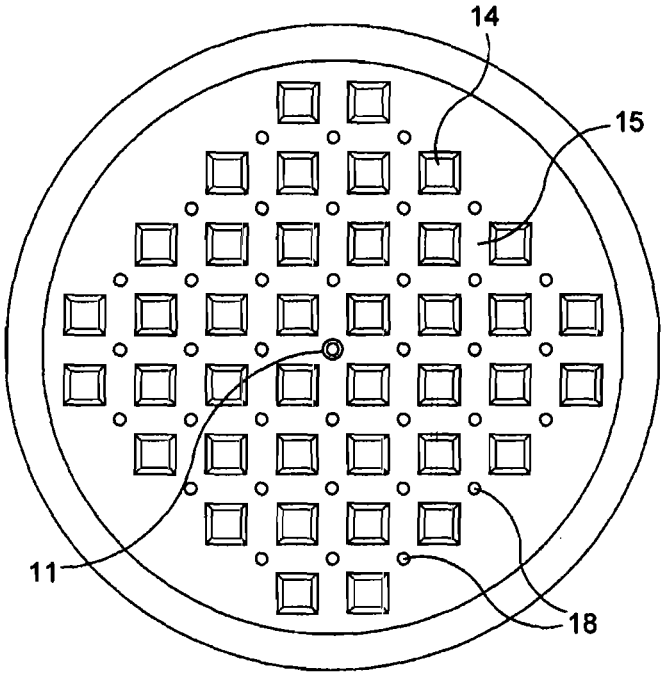
FIG. 8 shows a view along cross sectional plane A of FIG. 7.

As shown in FIG. 6, the capsule may be associated with a sealing means 40 ensuring liquid-tightness between the capsule and the injection part of the beverage production machine. For instance, the sealing means is a silicone ring applied onto the base of the rim and sidewall or a plastic lip or projection or an excessive thickness of plastic integral to the rim. Such means 40 participates to the liquid-tight arrangement with the beverage production machine 12 as illustrated in FIGS. 7 and 8.

The machine usually comprises a capsule holder 13 formed by a plate which comprises a series of relief elements 14 and recessed elements or channels 15. The relief elements can be shaped as small two-stage truncated pyramids. The number of pyramids is usually between 25 and 40. The capsule 1A is applied onto the capsule holder with its delivery wall being compressed onto the corrugated surface of the holder while the rim 4 of the capsule is taken in sandwich between the holder and pressing surface 16 of a water injection cage 17. Once placed in the machine, hot water is injected under pressure through the bottom wall 3 of the capsule via perforations created by the blades 7. Hot water traverses the coffee bed and passes through the surface of the filtering wall 9 to finally exit via the calibrated orifice 11 (or 11A, 11B). The coffee extract is collected by recessed elements or channels 15 formed between the relief elements 14, e.g., truncated pyramids, of the capsule holder and evacuated by the many small orifices 18 provided in the bottom and at the intersection of the channels. The flow of coffee thus takes a relatively tortuous path where it must find its way through the restriction of the calibrated orifice 11 (or 11A, 11B) and then via the channels where there is a pressure release and finally through the orifices 18 in the capsule holder. As in FIG. 7, each orifice of the capsule holder has a very small inlet diameter, e.g. , 100-300 microns, and a flared profile in direction of the outlets.

Figure 9:
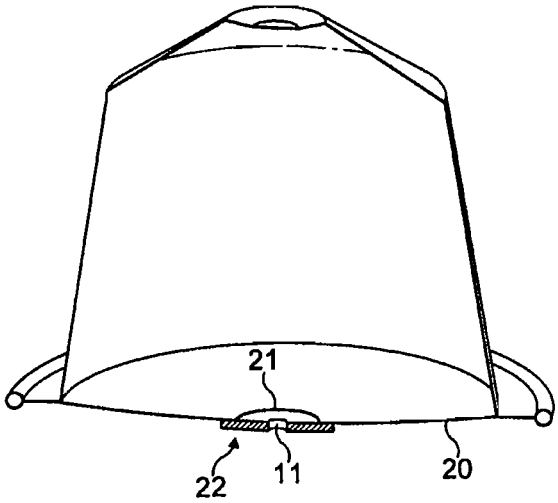
FIG. 9 shows a perspective and cross sectional view of a capsule according to a second embodiment.
Figure 10:
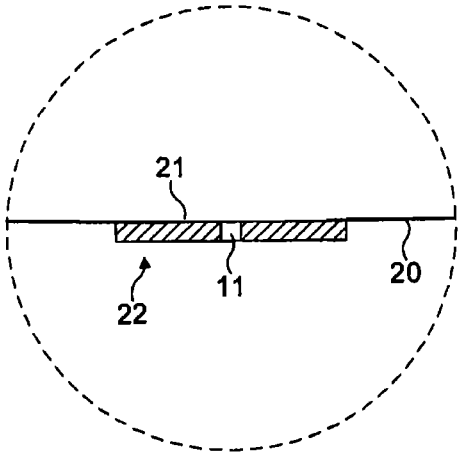
FIG. 10 shows a detail of the delivery wall of the capsule of FIG. 9.

In a second embodiment illustrated in FIGS. 9 and 10, the beverage delivery wall is constituted by a wall portion 20, sealed to the body, with a large opening 21 closed by a piece 22 containing the calibrated orifice 11. In such case, the piece can be made of a thickness and rigidity which is different from the portion of wall. This results in a possibly light-weight capsule. Also, the piece can be produced by other techniques than the rest of the portion of wall. For instance, the portion of wall 20 is a plastic foil taken from a plastic film or sheet whereas the piece 22 is a plastic injection-molded element. The apertured piece 22 can be sealed, either externally or internally, to the portion of wall 20 by heat sealing or ultrasonic sealing for instance.

Figure 11:
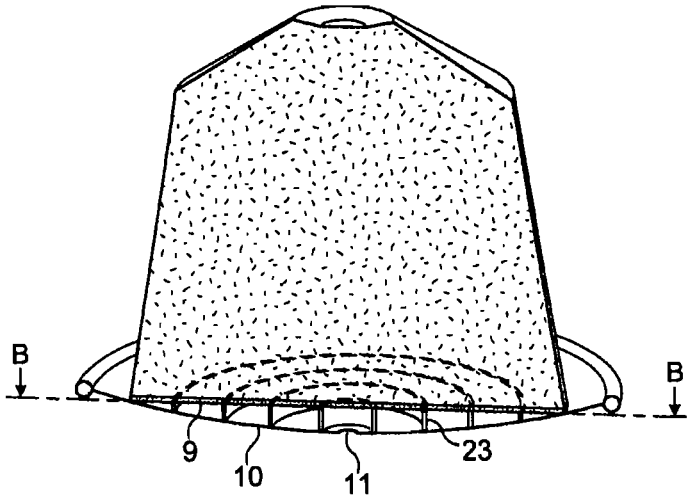
FIG. 11 shows a perspective and cross sectional view of a capsule according to a third embodiment.
Figure 12:
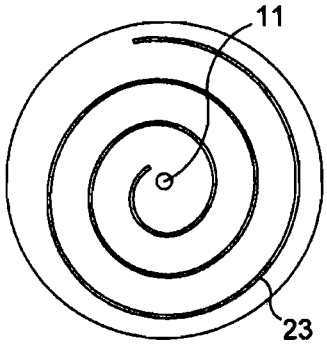
FIG. 12 shows a cross sectional view along plane B.
Figure 13:
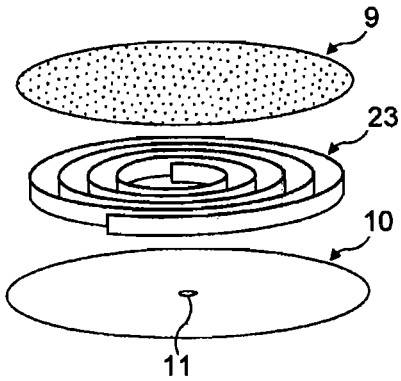
FIG. 13 shows an exploded view of the delivery side of the capsule of FIG. 11.

In a third embodiment illustrated in FIGS. 11 to 13, the capsule comprises a bracing element 23 such as a spiral-shaped element which is placed between the filtering element and the beverage delivery wall. The element provides the function of maintaining a gap between the two walls 9, 10 when the capsule is compressed onto the capsule holder as the relief elements tend to obstruct the flow. The bracing element 23 is also such that the flow of coffee coming out of the filtering element must travels a longer path to arrive at the orifice than in absence of such bracing element 23. The filter wall 9 can be slightly deformable to allow the delivery wall 10 to take a flat configuration when pressed on the capsule holder. However, it may also be envisaged to have a fully flat delivery wall 10 and the filter wall being preformed inwardly with a recess enabling the insertion of the bracing element 23.

Figure 14:
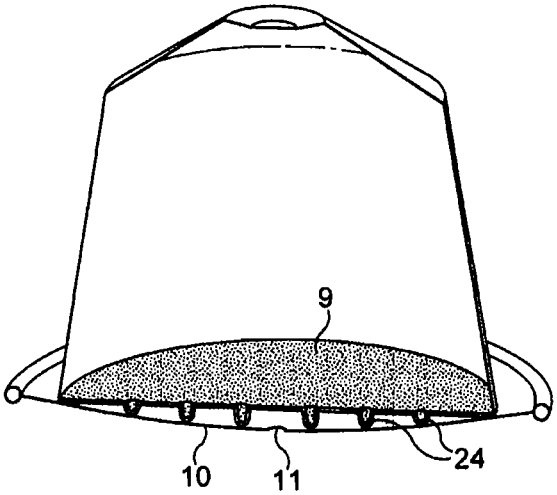
FIG. 14 shows a perspective and cross sectional view of a capsule according to a fourth embodiment.
Figure 15:
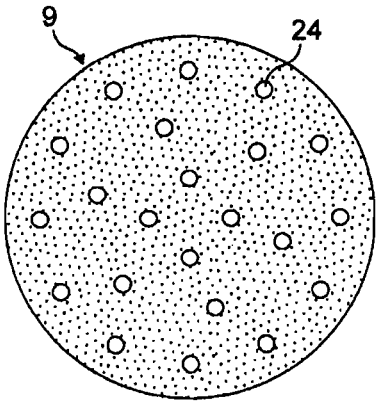
FIG. 15 shows a bottom view of the capsule of FIG. 14 with the delivery wall removed.

In the fourth embodiment illustrated in FIGS. 14 and 15, the bracing means has essentially the function to maintain the gap between the filtering wall 9 and the delivery wall 10. For this, the bracing means forms short studs 24 which are made integral with the filtering wall and oriented outwardly. Alternatively, the studs 24 are made integral with the delivery wall and oriented inwardly. The studs may, for instance, be of a height between 1 and 5 mm. The studs may take different shapes such as forming bumps, cones, ridges or crosses, etc.

Figure 16:
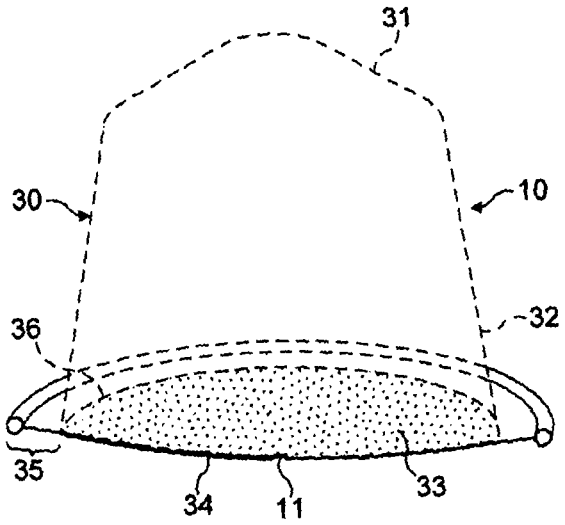
FIG. 16 shows a perspective and cross sectional view of a capsule according to a fifth embodiment.

In the fifth embodiment of FIG. 16, the capsule has a porous body 30, e.g. paper, shaped as a bag, i.e., with an upper wall 31, sidewall 32 and a lower wall 33. The lower wall 33 thus forms the filtering wall as well. The porous body 30 is sealed onto the beverage delivery wall 34 comprising the calibrated orifice 11. The wall 34 is so impermeable except at the orifice. In the preferred example, the delivery wall extends outwardly by a flange-like rim 35 onto which is formed the liquid tightness in machine i.e., between the pressing surface of the water injection cage and the rim. The porous body can thus be sealed at its periphery 36, i.e., via a small paper or plastic flange of the body, to the rim 35 of the delivery wall. Of course, the paper of the body could be replaced by a permeable polymer bag such as a non woven, a fabric or a thin film, or metal lattice. It should be noted that the body may be slightly flexible or rigid enough to be self supporting. Furthermore, the coffee could be compacted to provide a self supporting combination of body and coffee which can practically be pierced by the water injection blades.

Figure 17:
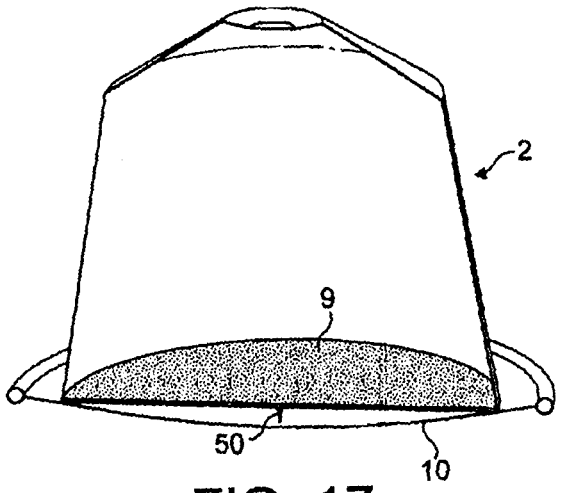
FIG. 17 shows a perspective and cross sectional view of a capsule according to a sixth embodiment.
Figure 18:
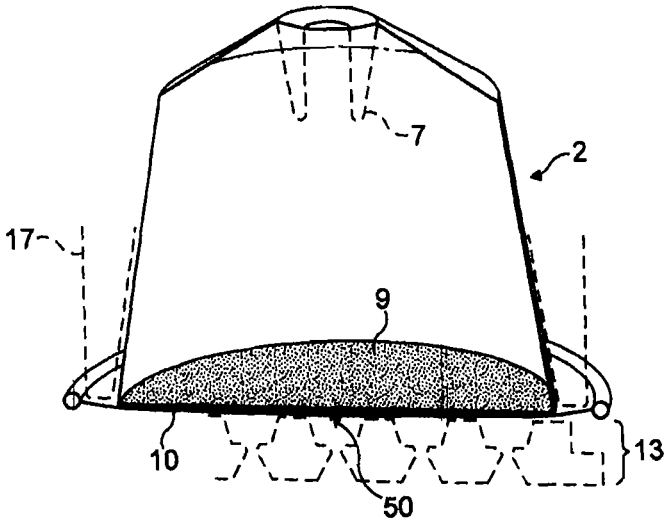
FIG. 18 shows the embodiment of FIG. 17 when the capsule is in insertion in the beverage production device.

In the embodiment of FIGS. 17 and 18, the capsule comprises means for providing the calibrating opening. In particular, the capsule comprises a calibrating perforating means 50, e.g., a small needle, which perforates the beverage delivery wall 10 to produce the calibrated orifice. The perforating means, in particular, a small needle 50 projects from the underside of the filtering wall 9 in direction of the wall 10. When the capsule is sealed, the delivery wall 10 is slightly convex due to the pressure of gas reigning in the capsule whereas the filtering wall remains substantially flat. Therefore, a small gap between the filtering wall 9 and the impermeable delivery wall 10 is provided enabling the insertion of the needle 50. In the sealed state of the capsule, the needle 50 is sufficiently distant from the delivery wall 50 to not perforate the wall. The needle is of small diameter, preferably, lower than 1.0 mm, in order to ensure the creation of the small calibrated hole in the delivery wall. Before use, the capsule, i.e., by its body 2 and wall 10 sealed together, is thus gas-tight. When the capsule is inserted in the machine, the delivery wall is slightly compressed against the capsule holder 13 thereby forcing the needle 50 to perforate the calibrated orifice through the delivery wall. It should be noted that the perforating means could also perforate the orifice 10 in the delivery wall as a result of the rise of pressure in the capsule.

What is claimed is:

1. A capsule for the production of a beverage by extraction in a beverage production machine comprising a capsule holder with relief and recessed elements, the capsule comprising:

an inverted cup-shaped body forming a chamber containing beverage forming ingredients;

a bottom injection wall;

a sidewall; and a delivery wall which is sealed to the body and which comprises at least one calibrated orifice provides a restriction that does not expand by more than 500% of its initial diameter as a result of the process of extraction, wherein when the capsule is placed in a beverage production machine in a capsule holder having relief and recessed elements, the beverage delivery wall is not tearable against the capsule holder relief and recessed elements during extraction but instead the restriction created by the calibrated orifice provides a certain back pressure which generates an elevated pressure in the capsule during extraction that generates an intimate interaction between the beverage forming ingredients in the capsule and injected water, as well as a consistent flow of the beverage delivered from the capsule.

2. The capsule of claim 1, wherein the delivery wall is substantially planar and a filtering wall is present between the chamber and the delivery wall.

3. The capsule of claim 2, which further comprises bracing means provided between the filtering wall and the deliver wall.

4. The capsule of claim 3, wherein the bracing means is preferably designed to maintain a gap along the full section of the filtering wall.

5. The capsule of claim 3, wherein the bracing means is an element separate from the filtering or delivery walls or is integral to one of the filtering or delivery walls.

6. The capsule of claim 1, wherein the delivery wall has a diameter of between 28 and 38 mm and has a flat structure or a deformable structure capable of taking a relatively flat configuration against the relief and recessed element of the capsule holder.

7. The capsule of claim 1, wherein the delivery wall comprises a single calibrated orifice having a diameter that is below 1 mm.

8. The capsule of claim 1, wherein the delivery wall comprises several orifices wherein the sum of the diameters of the orifices is below 1 mm.

9. The capsule of claim 1, wherein the delivery wall is made of aluminum, plastic, paper or combinations thereof.

10. The capsule of claim 1, wherein the body has a thickness is of from 0.25 to 2.5 mm and is made of aluminum, aluminum-polypropylene with the polypropylene facing the interior, polypropylene, polyethylene, polyamide, PP-PET or PP-EVOH-PP.

11. The capsule of claim 1, wherein the cup-shaped body is made of a porous material.

12. The capsule of claim 11, wherein the body has a thickness between 0.5 and 2.5 mm and is made of a degradable material of paper, another cellulose-based material, polylactic acid, or a starch-based material.

13. The capsule of claim 1, wherein the delivery wall comprises a portion of wall sealed onto the body and a separate disc-shaped element connected to the portion of wall and comprising the calibrated orifice.

14. The capsule of claim 1, wherein the calibrated orifice is prefabricated in the delivery wall.

15. The capsule of claim 1, wherein the calibrated orifice is positioned in the center of the delivery wall.

16. The capsule of claim 1 wherein the delivery wall comprises a single calibrated orifice having a diameter below 1mm or several calibrated orifices having diameters the sum of which is below 1 mm and the diameter of calibrated orifices (s) does not change by more than 150% during extraction.

17. The capsule of claim 16 wherein the diameter of the calibrated orifice(s) ranges between 100 and 350 microns and the capsule has a ratio of total surface of the calibration orifice(s) to total surface of the delivery wall that is between about 1:800 an 1:10000.

18. A apparatus for the preparation of a beverage comprising a beverage production machine comprising a capsule holder with relief and recessed elements and a water injection cage with a pressing edge, and a capsule according to claim 1, such that injection of water into the capsule forms the beverage.

19. A method of firming a beverage by providing a capsule according to claim 1; comprising injecting water into the capsule for combining with the beverage forming ingredients therein to form the beverage; and withdrawing the beverage from the capsule for consumption.

* * * * *